US010988871B2

(12) United States Patent
Fuhrmann et al.

(10) Patent No.: US 10,988,871 B2
(45) Date of Patent: Apr. 27, 2021

(54) METHOD FOR KNITTING A THREE-DIMENSIONAL KNITTED FABRIC

(71) Applicant: Rheinisch-Westfälische Technische Hochschule (RWTH) Aachen, Aachen (DE)

(72) Inventors: Kristina Fuhrmann, Aachen (DE); Thomas Gries, Aachen (DE); Isabel Schrepfer, Bonn (DE); Richard Riedlinger, Rosenfeld (DE)

(73) Assignee: RHEINISCH-WESTFÄLISCHE TECHNISCHE HOCHSCHULE (RWTH) AACHEN, Aachen (DE)

( * ) Notice: Subject to any disclaimer, the term of this patent is extended or adjusted under 35 U.S.C. 154(b) by 92 days.

(21) Appl. No.: 16/337,007

(22) PCT Filed: Oct. 4, 2017

(86) PCT No.: PCT/EP2017/075224
§ 371 (c)(1),
(2) Date: Mar. 27, 2019

(87) PCT Pub. No.: WO2018/065468
PCT Pub. Date: Apr. 12, 2018

(65) Prior Publication Data

US 2019/0233989 A1 Aug. 1, 2019

(30) Foreign Application Priority Data

Oct. 7, 2016 (DE) ..... 10 2016 119 052.7

(51) Int. Cl.
*D04B 1/22* (2006.01)
*D04B 1/10* (2006.01)

(52) U.S. Cl.
CPC ..... *D04B 1/22* (2013.01); *D04B 1/108* (2013.01); *D10B 2403/0113* (2013.01); *D10B 2403/0331* (2013.01); *D10B 2403/0332* (2013.01)

(58) Field of Classification Search
CPC . D04B 1/22; D04B 1/108; D04B 1/10; D04B 1/102
See application file for complete search history.

(56) References Cited

U.S. PATENT DOCUMENTS 2,127,780 A * 8/1938 Marshall ..... D04B 9/54 66/172 E
3,049,901 A * 8/1962 Greczin ..... A47L 9/24 66/190

(Continued)

FOREIGN PATENT DOCUMENTS

GB 2172019 A 9/1986
JP 2002146654 A 5/2002

(Continued)

OTHER PUBLICATIONS

International Search Report and Written Opinion for PCT/EP2017/075224 dated Dec. 18, 2017 (13 pages; with English translation).

*Primary Examiner* — Danny Worrell
(74) *Attorney, Agent, or Firm* — Bejin Bieneman PLC

(57) ABSTRACT

A three-dimensional knitted fabric with a large-diameter circular knitting machine is knitted with a plurality of stitches that form a plurality of stitch courses oriented in each case in a stitch-course direction of the knitted fabric and a plurality of stitch wales oriented in each case in a stitch-wale direction of the knitted fabric, wherein at least one of the stitches is in the form of at least one corrugation-forming stitch, which extends in the stitch-wale direction (Continued)

over a plurality of stitch courses and binds at least one corrugation in the knitted fabric.

15 Claims, 4 Drawing Sheets

(56) References Cited

U.S. PATENT DOCUMENTS

| | | | | |
|---|---|---|---|---|
| 4,797,311 | A * | 1/1989 | Kemp | D04B 1/102 428/92 |
| 5,149,583 | A * | 9/1992 | Saarikettu | D04B 1/123 442/312 |
| 6,116,057 | A * | 9/2000 | Roell | D04B 1/22 66/64 |
| 6,272,888 | B1 * | 8/2001 | Fujita | A41B 13/005 66/172 E |
| 2003/0131634 | A1 * | 7/2003 | Sciacca | D04B 1/24 66/64 |
| 2004/0011085 | A1 * | 1/2004 | Sciacca | D04B 1/24 66/8 |

FOREIGN PATENT DOCUMENTS

| | | | |
|---|---|---|---|
| JP | 2004232112 | A | 8/2004 |
| JP | 2006144194 | A | 6/2006 |
| WO | 02/04726 | A1 | 1/2002 |

* cited by examiner

METHOD FOR KNITTING A THREE-DIMENSIONAL KNITTED FABRIC

CROSS-REFERENCE TO RELATED APPLICATIONS

This application is a national stage of, and claims priority to, Patent Cooperation Treaty Application No. PCT/EP2017/075224, filed on Oct. 4, 2017, which application claims priority to German Application No. DE 10 2016 119 052.7, filed on Oct. 7, 2016, which applications are hereby incorporated herein by reference in their entireties.

FIELD

The present disclosure relates to a mechanical method for knitting a three-dimensional knitted fabric. By way of this method, near-net-shape knitted fabrics for example for technical textiles are intended to be producible.

BACKGROUND

For the production of conventional three-dimensional textile products, making-up is unavoidable. The term making-up means all the operations that are necessary for producing a textile product. These include in particular the conversion of a plurality of flat textile products into a three-dimensional form by cutting, arranging, introducing applications and/or stitching. For some time, there has been the desire to produce three-dimensional knitted fabrics in a single process step directly on a (single) knitting machine, in order to reduce or even to avoid the effort for making-up. Therefore, methods for producing three-dimensional knitted fabrics using what are known as flat knitting machines have already been developed. These methods allow three-dimensional knitted fabrics or three-dimensionally formed textiles to be produced in one piece and in one process without stitching, without cutting and/or without making-up. This means that the three-dimensional knitted fabric can be fully manufactured on a single machine, which was previously not possible or was possible only in several stages with high production effort. The known methods are in this case configured such that they have to be carried out with what are known as flat knitting machines, because the arrangement of the needles in flat knitting machines allows the increasing and decreasing of stitches, which was previously considered to be absolutely necessary in order to produce three-dimensional knitted fabrics. However, flat knitting machines are less productive and so the known methods have only limited suitability for relatively large runs.

Compared with flat knitting machines, what are known as large-diameter circular knitting machines are about six times more productive. For this reason, large-diameter circular knitting machines are primarily used for the textile mass production of two-dimensional knitted fabrics. In order to produce T-shirts, for example, the two-dimensional knitted fabrics have to be complicatedly made up into a three-dimensional form in a downstream process. However, large-diameter circular knitting machines are not suitable for carrying out the abovementioned methods for producing three-dimensional knitted fabrics. Therefore, at present, a productive production method that allows flexible three-dimensional geometric shaping of knitted products does not exist. However, the trend in the textile industry is toward ever shorter development cycles for new products or prototypes. In addition, there is a growing customer desire for increasingly individual production, for example tailored to body shape.

It is possible to obtain a three-dimensional knitted fabric in that first of all a planar (two-dimensional) knitted fabric is produced (on a machine), said fabric then being converted into a three-dimensional knitted fabric in a subsequent step by a joining process, in particular a stitching process, at edges of the knitted fabric. In this case, the edges of the knitted fabric may need to be processed or produced after the knitting process and/or before the joining process. The stitching, making-up and/or cutting of two-dimensional knitted fabrics to form a three-dimensional knitted fabric is complicated, results in undesired offcuts and can lead to insufficient shape accuracy of the three-dimensional knitted fabric.

SUMMARY

Disclosed herein is a method for knitting a three-dimensional knitted fabric with which three-dimensional knitted fabrics can be manufactured highly efficiently in one process step with a large-diameter circular knitting machine. In particular, three-dimensional knitted fabrics or three-dimensionally formed textiles can be manufactured without stitching, without cutting and/or without making-up in one piece and in an automated and rapid process. A three-dimensional knitted fabric can be produced fully on a single machine.

The disclosed method includes the features of the independent claim. Further advantageous configurations are specified in the dependent claims. It should be noted that the features listed individually in the dependent claims can be combined in any technologically meaningful manner and define further configurations of the invention. Furthermore, the features specified in the claims are explained and defined in more detail in the description, wherein further preferred configurations are presented.

In the method for knitting a three-dimensional knitted fabric with a large-diameter circular knitting machine, the knitted fabric is knitted with a plurality of stitches that form a plurality of stitch courses oriented in each case in a stitch-course direction of the knitted fabric and a plurality of stitch wales oriented in each case in a stitch-wale direction of the knitted fabric, wherein at least one of the stitches is in the form of at least one corrugation-forming stitch, which extends in the stitch-wale direction over a plurality of stitch courses and binds at least one corrugation in the knitted fabric.

The method serves for the production of a knitted fabric or of a textile product in a three-dimensional form, wherein the knitted fabric is in particular a (single-thread) knit. A knit is understood to be a textile fabric produced from a thread or from a thread system by stitch formation. Thus, the knit is formed from a network of stitches. In the production of the knitted fabric, a thread is processed in a horizontal orientation to form a plurality of stitches. A stitch represents the binding element and the smallest dimensionally stable unit of the knitted fabric. The stitch includes of a thread loop which is interlinked with other thread loops. The stitch is held by four binding points and includes of a stitch head, two shanks and two stitch feet. The stitches arranged alongside one another in a stitch-course direction of the knitted fabric form what is known as a stitch course, and the stitches arranged one above another in a stitch-wale direction of the knitted fabric form what is known as a stitch wale. The knitted fabric thus includes of a plurality of stitch courses oriented in each case in the stitch-course direction of the knitted fabric and a plurality of stitch wales oriented in each case in the stitch-wale direction of the knitted fabric, which are connected together. The stitch-course direction is in particular a horizontal direction of the knitted fabric and/or a direction of needle movement of the large-diameter circular knitting machine. The stitch-wale direction is in particular a vertical direction of the knitted fabric. The knitting process is characterized by individually moved needles that successively execute the phases of the stitch-forming operation. The method is carried out with a large-diameter circular knitting machine, the needles of which are arranged in particular in a rotating knitting cylinder and the needle guides (cam parts) of which are in particular stationary. The large-diameter circular knitting machine is for example a single-sided large-diameter circular knitting machine, a double-sided large-diameter circular knitting machine or what is known as a spacer-fabric large-diameter circular knitting machine. The method is moreover able to be carried out in particular without any reciprocating motion of the knitting cylinder of the large-diameter circular knitting machine. In addition, in particular no stitch transfer is necessary. The method is furthermore able to be carried out in particular on commercially customary large-diameter circular knitting machines that do not have to have any particular technical adaptations.

At least one of the stitches is in the form of a corrugation-forming stitch, which extends in the stitch-wale direction over a plurality of stitch courses. This means that, while the knitted fabric is being knitted, a plurality of stitch courses are arranged between the stitch feet of the at least one corrugation-forming stitch and the stitch head of the at least one corrugation-forming stitch. In other words, the stitch shanks of the at least one corrugation-forming stitch extend over a plurality of stitch courses. The at least one corrugation-forming stitch extends in the stitch-wale direction of the knitted fabric preferably over at least 5 stitch courses, particularly preferably over at least 10 stitch courses and/or preferably over at most 150 stitch courses, particularly preferably over at most 100 stitch courses. The number over which the at least one corrugation-forming stitch extends can also be made dependent on the material thickness of the yarn material used, the stitch height (loop sinking) and/or the thread tension.

In addition, the at least one corrugation-forming stitch has in particular a length, from its stitch feet to its stitch head in the stitch-wale direction, which is greater than the length of the stitch that is (directly) adjacent in the stitch-course direction in the stitch course of the at least one corrugation-forming stitch. Furthermore, the at least one corrugation-forming stitch can also be formed in that the needle of the respective corrugation-forming stitch is not driven out for a particular time period. The process of forming the at least one corrugation-forming stitch ends as soon as the needle is driven out again. Following the formation of the at least one corrugation-forming stitch, the at least one corrugation-forming stitch gathers at least one corrugation in the knitted fabric or the at least one corrugation-forming stitch is tightened such that the spacing between the stitch feet of the at least one corrugation-forming stitch and the stitch head of the at least one corrugation-forming stitch is reduced. The length of the at least one corrugation-forming stitch in the stitch-wale direction can then correspond for example to the length of the stitch that is (directly) adjacent in the stitch-course direction in the stitch course of the at least one corrugation-forming stitch. As a result, the at least one corrugation-forming stitch binds a region, located between the stitch feet of the at least one corrugation-forming stitch and the stitch head of the at least one corrugation-forming stitch of the knitted fabric, to form at least the corrugation. The at least one corrugation is in particular in the form of a loop and/or of a dart. The at least one corrugation has a corrugation peak and two corrugation flanks, which each lead from the corrugation peak to a corrugation valley. The at least one corrugation-forming stitch binds the two corrugation flanks of the at least one corrugation preferably in the region of the two corrugation valleys.

As a result of the formation of the at least one corrugation in the knitted fabric, in a local region of the knitted fabric, material is taken away from the surface of the knitted fabric such that the forces or tensions generated by the at least one corrugation in the knitted fabric bring the original sheet-like structure into a three-dimensional form. As a result of the formation of such corrugation-forming stitches, three-dimensional knitted fabrics are producible in a defined manner with a large-diameter circular knitting machine. As a result of the deliberate arrangement of the corrugation-forming stitches, desired three-dimensional structures can be formed in the knitted fabric. Thus, three-dimensional knitted fabrics are producible in one process even with a large-diameter circular knitting machine and the process steps, otherwise required in the textile chain, of cutting and making-up in order to produce the three-dimensional knitted fabric are avoidable. In this way, three-dimensionally knitted surfaces can be produced more productively and more cost-effectively on a large-diameter circular knitting machine than was possible with previous methods with flat knitting machines. From the three-dimensional knitted fabric, it is possible to produce for example sports articles, bras, clothing tailored individually to the body, and/or interior textiles for motor vehicles.

The at least one corrugation can at least partially shorten the knitted fabric in the stitch-wale direction. This means in particular that the knitted fabric has a length in the stitch-wale direction in regions in which the at least one corrugation-forming stitch is formed which is less than a length of the knitted fabric in the stitch-wale direction in regions in which no corrugation-forming stitches are formed. At least partially shortened should also be understood here as meaning that the at least one corrugation does not shorten the knitted fabric in the stitch-wale direction across the entire width in the stitch-course direction of the knitted fabric, but only in certain regions. This can be achieved by a deliberate arrangement of one or more corrugation-forming stitches in one of the stitch courses. The arrangement of the at least one corrugation-forming stitch takes place depending on the desired three-dimensional shape of the knitted fabric.

The at least one corrugation-forming stitch can fold a plurality of stitch courses to form the at least one corrugation. The at least one corrugation-forming stitch in this case folds, to form the at least one corrugation, all the stitch courses that are arranged between the stitch feet and the stitch head of the at least one corrugation-forming stitch. The at least one corrugation-forming stitch preferably folds at least 5 stitch courses, particularly preferably at least 10 stitch courses and/or preferably at most 150 stitch courses, particularly preferably at most 100 stitch courses to form the at least one corrugation.

The at least one corrugation can extend in the stitch-course direction. This means in particular that the corrugation peak of the at least one corrugation extends in the stitch-course direction.

Preferably, in at least one stitch course, a plurality of corrugation-forming stitches are formed, which extend in the stitch-wale direction at least partially over a different number of stitch courses. As a result, a corrugation can be formed in the knitted fabric which has a different height (perpendicularly to the surface of the knitted fabric) in the stitch-course direction. As a result, the knitted fabric can be shortened to different extents along a stitch course in the stitch-wale direction, in order to create a desired topography of the three-dimensional knitted fabric.

The three-dimensional knitted fabric can be created by taking away excess material from a two-dimensional pattern, wherein the taking away of the excess material can take place by way of the at least one corrugation. The two-dimensional pattern is in particular a two-dimensional representation of surface segments or topographical segments of the three-dimensional knitted fabric and the regions of excess material that are located therebetween. In the conventional production of three-dimensional knitted fabrics, the individual surface segments of the three-dimensional knitted fabric are cut out of a two-dimensional surface material and subsequently stitched together to form the three-dimensional knitted fabric. The excess material or the resultant offcuts is/are disposed of. However, in the method according to the invention, the excess material is not separated from the surface segments of the three-dimensional knitted fabric, but rather taken away by the at least one corrugation-forming stitch in the form of the at least one corrugation.

The "taking away" comprises in particular gathering, folding, bringing together or the like of the excess material (proceeding from a known pattern).

The taken-away material is spatially displaced and optionally fixed to such an extent that, in the remaining parts of the knitted fabric, a tension or force is introduced, which causes these remaining parts of the knitted fabric to move out of a two-dimensional plane.

The resultant corrugations can form different heights in the extension direction (in each case and/or with respect to one another). In the region of a greater height of the corrugation, a greater amount of excess material is taken away. In the region of a smaller height of the corrugation, a smaller amount of excess material is taken away.

The taken-away material (or corrugations) is thus not separated and/or removed before and/or during the formation of the three-dimensional form.

The three-dimensional form of the knitted fabric can be stabilized for example in that the taken-away material is fixed in a border region with at least one other part of the knitted fabric, for example by a seam.

After the formation of the three-dimensional form, the taken-away material can remain on the knitted fabric or (at least partially) be removed.

A three-dimensional knitted fabric is present in particular when the knitted fabric is curved (to a predominant extent and/or substantially in a specifically dimensionally stable manner).

The three-dimensional knitted fabric can be designed such that it forms substantially and/or at least on one side a smooth surface, or a local microstructure (folds, etc.) can be found only in the region of the taking-away of excess material.

Two corrugation-forming stitches that are adjacent in the stitch-course direction can be spaced apart by at least one stitch wale.

The at least one corrugation-forming stitch can be formed by at least one float stitch. The float stitch is in particular a section of thread that extends in the direction of the stitch courses or the stitch-course direction of the knitted fabric over the at least one corrugation-forming stitch and is bordered on both sides by a stitch.

The at least one corrugation can be formed on a left-hand fabric side of the knitted fabric. The "left-hand fabric side" of the knitted fabric is usually that side of the knitted fabric that is not visible from the outside in the product to be produced.

In order to perform the method, a large-diameter circular knitting machine is proposed, which is suitable for carrying out the method proposed herein and is set up for this purpose. To this end, the large-diameter circular knitting machine can comprise an (internal or external) control unit, in which a corresponding control of the feed rates and needles is specified in accordance with the essential features of the method. If appropriate, it is also possible here to provide retaining structures (for example in the manner of a negative form) which support three-dimensional processing of the knitted fabric.

BRIEF SUMMARY OF THE DRAWINGS

The present subject matter is explained in more detail in the following text on the basis of the figures. It should be noted that the figures show a particularly preferred embodiment variant of the invention but the latter is not limited thereto. In this case, identical elements in the figures are provided with the same reference signs. In the figures, by way of example and schematically.

DESCRIPTION WITH REFERENCE TO THE DRAWINGS

Figure 1:
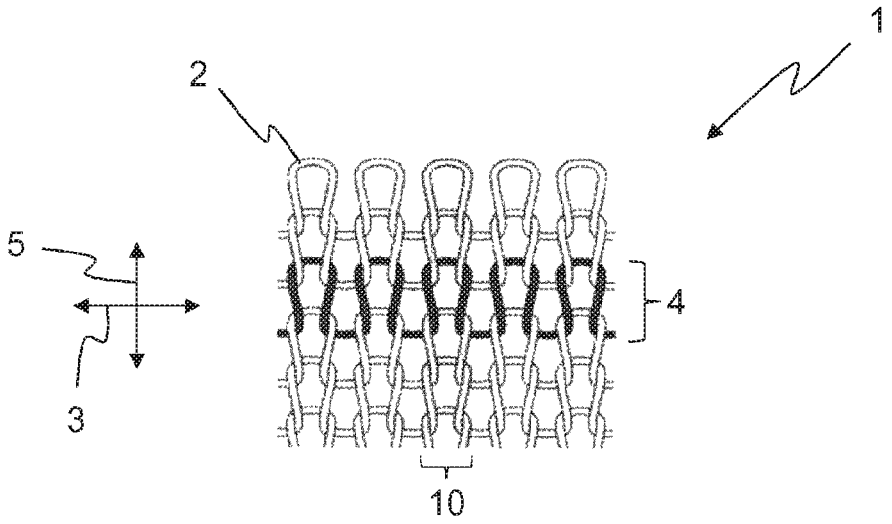
FIG. 1 shows the structure of a knitted fabric.

FIG. 1 shows an enlarged illustration of the structure of a knitted fabric 1 made up of a plurality of stitches 2. The stitches 2 each consist of a thread loop interlinked with other thread loops. The stitches 2 arranged alongside one another in a stitch-course direction 3 form a stitch course 4. The stitches 2 arranged one above another in a stitch-wale direction 5 form a stitch wale 10.

Figure 2:
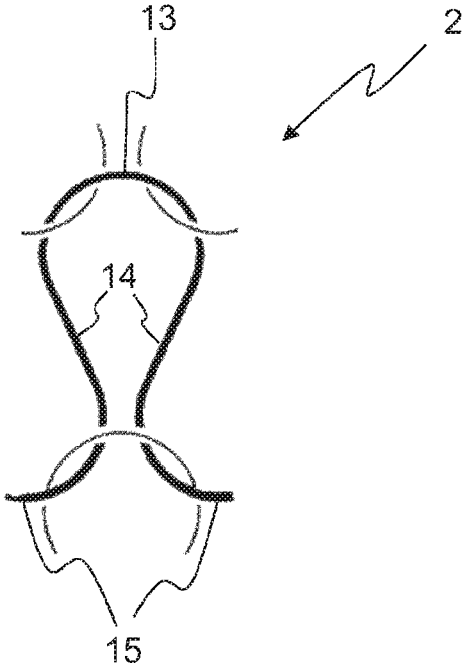
FIG. 2 shows an enlarged illustrated of a stitch of the knitted fabric.

FIG. 2 shows an enlarged illustration of one of the stitches 2, which is held by four binding points. The stitch 2 includes of a stitch head 13, two stitch shanks 14 and two stitch feet 15.

Figure 3:
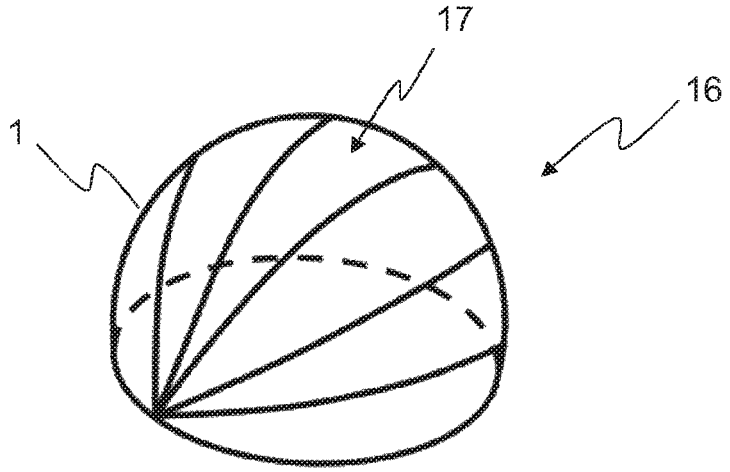
FIG. 3 shows a schematic illustration of a hemisphere to be knitted by a three-dimensional knitted fabric.
Figure 4:
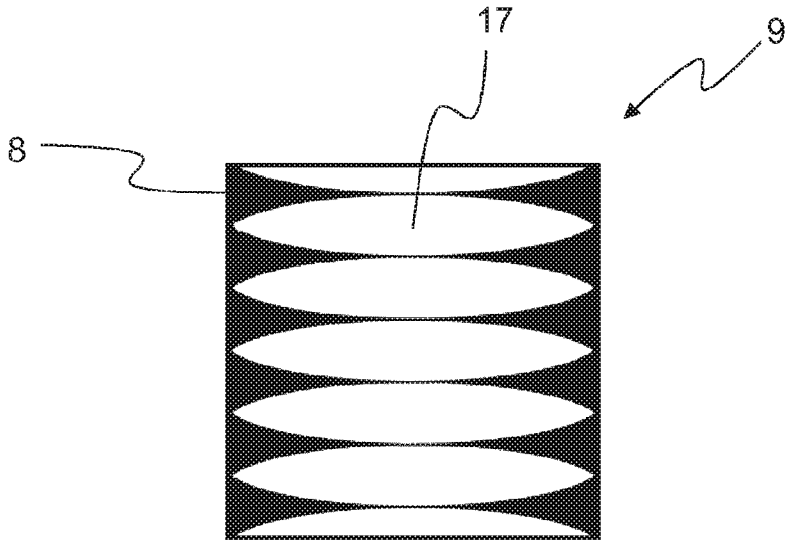
FIG. 4 shows a two-dimensional pattern of the hemisphere.

FIG. 3 shows by way of example a hemisphere 16 to be produced from a three-dimensional knitted fabric 1, and FIG. 4 shows an associated two-dimensional pattern 9. The two-dimensional pattern 9 has flat sphere surface segments 17, which are required for composing the hemisphere 16. Located between the sphere surface segments 17 is excess material 8, which, during the present method, is taken away by the formation of corrugation-forming stitches 6, shown in FIG. 6, in the region of the excess material 8, such that the hemisphere 16 shown in FIG. 3 is produced from the flat material.

Figure 5:
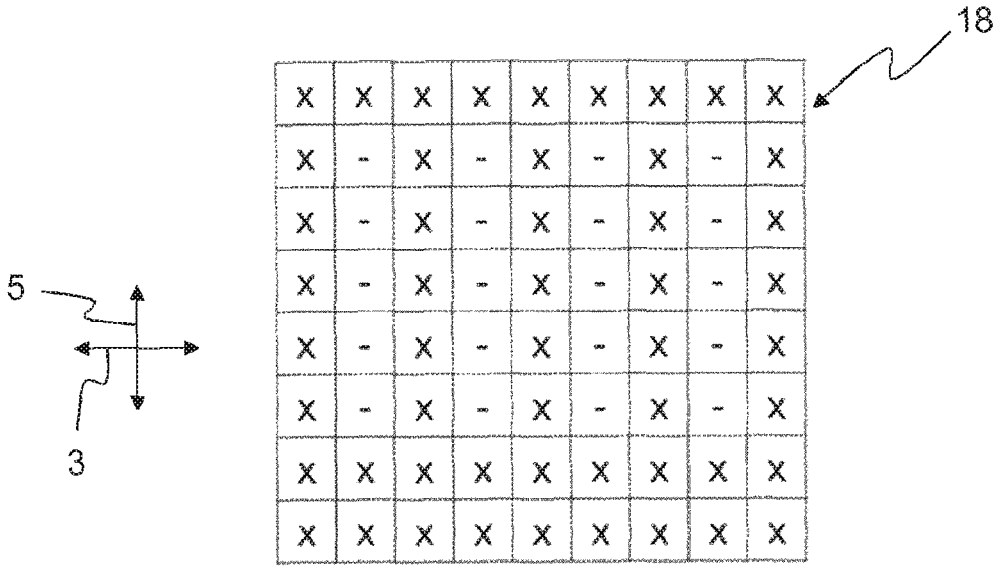
FIG. 5 shows a pixel description for a controller of a large-diameter circular knitting machine for producing corrugation-forming stitches.
Figure 6:
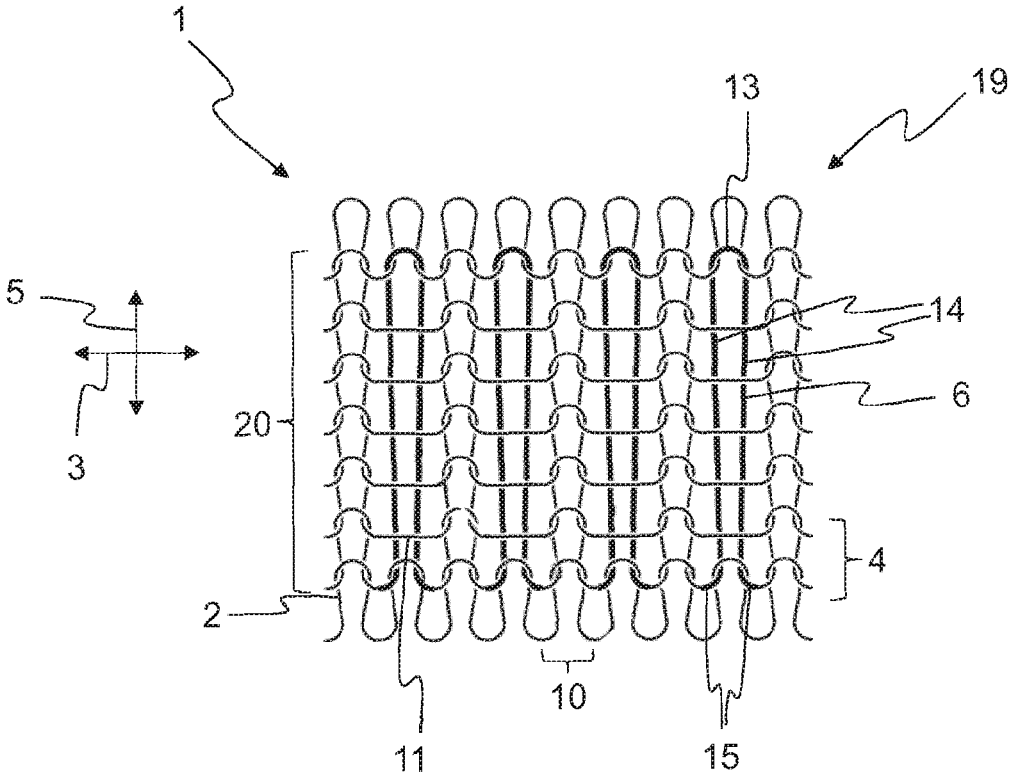
FIG. 6 shows the stitch pattern associated with the pixel description.

FIG. 5 shows an excerpt from a pixel description 18 for a controller of a large-diameter circular knitting machine in the region of the excess material 8 shown in FIG. 4, and FIG. 6 shows the associated stitch pattern 19. The pixel description 18 indicates by way of pixels the point at which a stitch 2 (identified by an "x") is to be formed and the point at which a float stitch 11 (identified by "–") is to be formed. It should be clarified that, rather than a stitch 2, the "x" can also represent what is known as a "loop" as formation element. It can be seen from FIG. 6 that four corrugation-forming stitches 6 have been formed in the stitch course 4. The stitch shanks 14 span six stitch courses 4 between the stitch head 13 and the stitch feet 15 of the corrugation-forming stitches 6 in the stitch-wale direction 5. The individual corrugation-forming stitches 6 are each spaced apart in the stitch-course direction 3 by a stitch wale 10. The individual stitch wales 10 are connected together via a float stitch 11. The corrugation-forming stitches 6 are shown merely schematically in FIG. 6. The corrugation-forming stitches 6 actually have a length in the stitch-wale direction 5 that matches the length of the other stitches 2. As a result, the knitted fabric 1 is bound, in the corrugation region 20 located between the stitch heads 13 and the stitch feet 15 of the corrugation-forming stitches 6 or in the stitch courses 4 located in the corrugation region 20, to form a corrugation 7 shown in FIG. 7.

Figure 7:
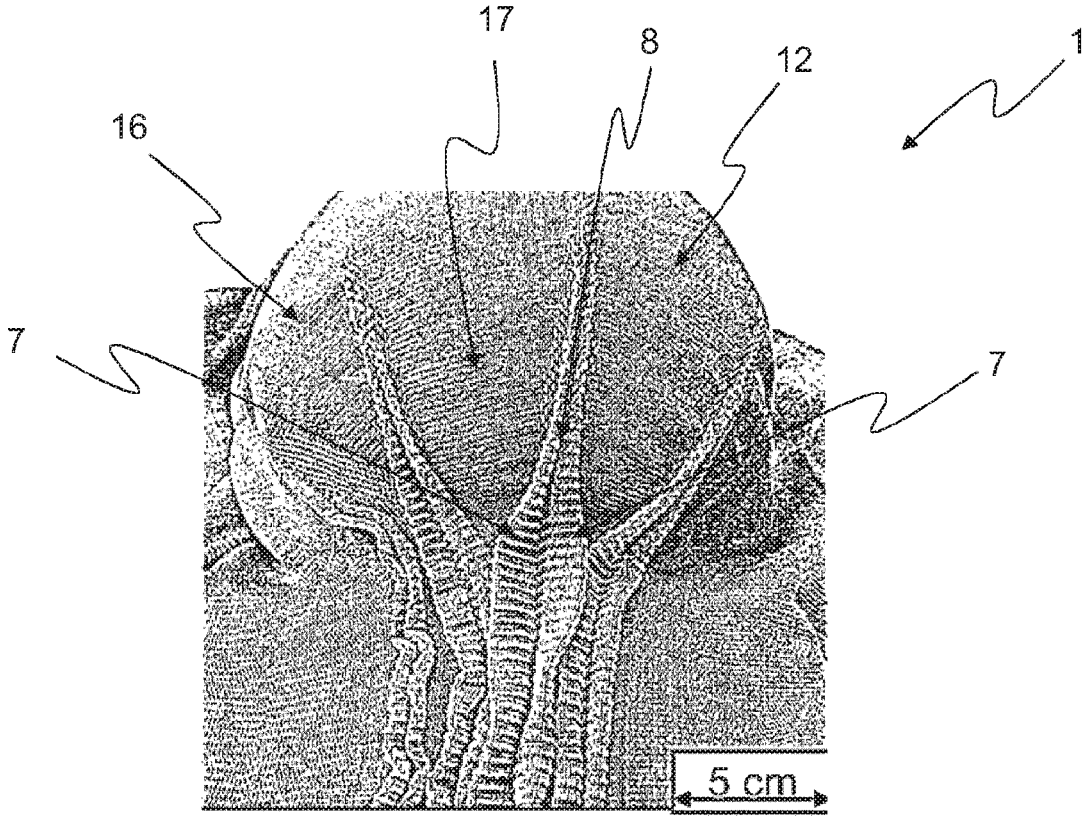
FIG. 7 shows a left-hand fabric side of the three-dimension knitted fabric knitted as a hemisphere.

FIG. 7 shows the three-dimensional knitted fabric 1, knitted to form the hemisphere 16, from a left-hand fabric side 12. The sphere surface segments 17 and the excess material 8 taken away by corrugations 7 are apparent. The corrugations 7 are located on a left-hand fabric side 12 of the three-dimensional knitted fabric 1.

Figure 8:
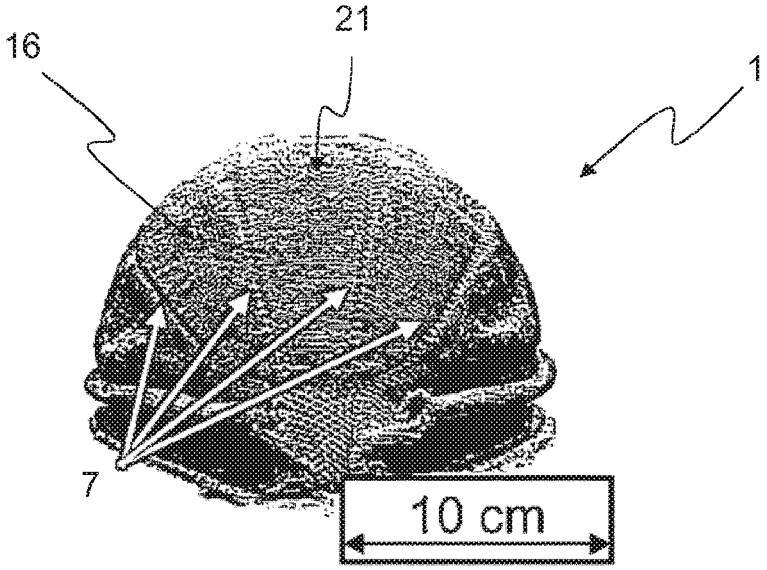
FIG. 8 shows a right-hand fabric side of the three-dimension knitted fabric knitted as a hemisphere.

FIG. 8 shows the three-dimensional knitted fabric 1, knitted to form the hemisphere 16, from a right-hand fabric side 21, on which the corrugations 7 cannot be seen.

The proposed method for knitting the three-dimensional knitted fabric is characterized by particularly high productivity and low costs.

LIST OF REFERENCE SIGNS

1 Three-dimensional knitted fabric
2 Stitch
3 Stitch-course direction
4 Stitch course
5 Stitch-wale direction
6 Corrugation-forming stitch
7 Corrugation
8 Excess material
9 Two-dimensional pattern
10 Stitch wale
11 Float stitch
12 Left-hand fabric side
13 Stitch head
14 Stitch shanks
15 Stitch feet
16 Hemisphere
17 Sphere surface segment
18 Pixel description
19 Stitch pattern
20 Corrugation region
21 Right-hand fabric side

The invention claimed is:

1. A method for knitting a three-dimensional knitted fabric with a circular knitting machine, comprising:

knitting the knitted fabric with a plurality of stitches that form a plurality of stitch courses oriented in each case in a stitch-course direction of the knitted fabric and a plurality of stitch wales oriented respectively in a stitch-wale direction of the knitted fabric;

wherein at least one of the stitches is in the form of at least one corrugation-forming stitch that extends in the stitch-wale direction over a plurality of stitch courses and binds at least one corrugation in the knitted fabric; and wherein the binding of the at least one corrugation by the corrugation forming stitch takes away excess material from a two-dimensional pattern such that the three-dimensional knitted fabric is created.

2. The method of claim 1, wherein the at least one corrugation at least partially shortens the knitted fabric in the stitch-wale direction.

3. The method of claim 1, wherein the at least one corrugation-forming stitch folds a plurality of stitch courses to form the at least one corrugation.

4. The method of claim 1, wherein the at least one corrugation extends in the stitch-course direction.

5. The method of claim 1, wherein, in at least one stitch course, a plurality of corrugation-forming stitches are formed extending in the stitch-wale direction at least partially over a different number of stitch courses.

6. The method of claim 1, wherein two corrugation-forming stitches that are adjacent in the stitch-course direction are spaced apart by at least one stitch wale.

7. The method of claim 1, wherein the at least one corrugation-forming stitch is formed by at least one float stitch.

8. The method of claim 1, wherein the at least one corrugation is formed on an inner side of the knitted fabric.

9. The method of claim 1, wherein the at least one corrugation-forming stitch extends in the stitch-wale direction of the knitted fabric over at least 5 stitch courses.

10. The method of claim 6, wherein the at least one corrugation-forming stitch extends in the stitch-wale direction of the knitted fabric over at most 150 stitch courses.

11. The method of claim 1, wherein, following the formation of the at least one corrugation-forming stitch, the at least one corrugation-forming stitch gathers at least one corrugation in the knitted fabric.

12. The method of claim 1, wherein, following the formation of the at least one corrugation-forming stitch, the at least one corrugation-forming stitch is tightened such that a spacing between a stitch feet of the at least one corrugation-forming stitch and a stitch head of the at least one corrugation-forming stitch is reduced.

13. The method of claim 9, wherein, following the tightening of the at least one corrugation-forming stitch, a length of the at least one corrugation-forming stitch in the stitch-wale direction corresponds to a length of the stitch that is adjacent in the stitch-course direction in the stitch course of the at least one corrugation-forming stitch.

14. The method of claim 1, wherein the at least one corrugation-forming stitch binds a region, located between a stitch feet of the at least one corrugation-forming stitch and a stitch head of the at least one corrugation-forming stitch, of the knitted fabric to form the at least one corrugation.

15. The method of claim 1, wherein the at least one corrugation is in the form of a loop or of a dart.

* * * * *